US006224336B1

(12) United States Patent
Kercher

(10) Patent No.: US 6,224,336 B1
(45) Date of Patent: May 1, 2001

(54) TRIPLE TIP-RIB AIRFOIL

(75) Inventor: David M. Kercher, Ipswich, MA (US)

(73) Assignee: General Electric Company, Cincinnati, OH (US)

( * ) Notice: Subject to any disclaimer, the term of this patent is extended or adjusted under 35 U.S.C. 154(b) by 0 days.

(21) Appl. No.: 09/328,470

(22) Filed: Jun. 9, 1999

(51) Int. Cl.[7] ..... F01D 5/18; F01D 5/20

(52) U.S. Cl. ..... 416/97 R; 416/92; 415/115; 415/173.4; 415/173.1

(58) Field of Search ..... 415/115, 173.1, 415/173.4, 173.5; 416/90 R, 92, 96 R, 96 A, 97 R, 97 A, 224

(56) References Cited

U.S. PATENT DOCUMENTS

| | | | | |
|---|---|---|---|---|
| 3,527,543 | * | 9/1970 | Howald | 416/92 |
| 3,854,842 | | 12/1974 | Caudill . | |
| 4,390,320 | * | 6/1983 | Eiswerth | 416/97 R |
| 4,767,268 | | 8/1988 | Auxier et al. . | |
| 4,863,348 | | 9/1989 | Weinhold . | |
| 5,183,385 | | 2/1993 | Lee et al. . | |
| 5,192,192 | * | 3/1993 | Ourhaan | 416/97 R |
| 5,261,789 | | 11/1993 | Butts et al. . | |
| 5,326,224 | * | 7/1994 | Lee et al. | 416/97 R |
| 5,403,158 | | 4/1995 | Auxier et al. . | |
| 5,458,461 | | 10/1995 | Lee et al. . | |
| 5,536,143 | * | 7/1996 | Jacala et al. | 416/96 R |
| 5,690,473 | * | 11/1997 | Kercher | 416/97 A |
| 5,733,102 | | 3/1998 | Lee et al. . | |

FOREIGN PATENT DOCUMENTS 852285 7/1998 (EP) .

OTHER PUBLICATIONS

U.S. application No. 08/955,226, Kercher, filed Nov. 22, 1997.*

* cited by examiner

*Primary Examiner*—Christopher Verdier
(74) *Attorney, Agent, or Firm*—Andrew C. Hess; Rodney M. Young

(57) ABSTRACT

A turbine airfoil includes pressure and suction sidewalls extending between leading and trailing edges and from root to tip. The tip includes a floor bounding an internal cooling channel within the airfoil which channels cooling air. The airfoil tip includes a first rib adjacent the pressure sidewall, a second rib spaced therefrom to define a first slot, and a third rib adjacent the suction sidewall to define a second slot with the second rib. The tip floor includes feed holes extending between the cooling channel and the first slot for supplying cooling air therein for discharge over the second rib towards the third rib.

19 Claims, 4 Drawing Sheets

TRIPLE TIP-RIB AIRFOIL

BACKGROUND OF THE INVENTION

The present invention relates generally to gas turbine engines, and, more specifically, to turbine blade cooling.

In a gas turbine engine, air is pressurized in a compressor and mixed with fuel and ignited in a combustor to generate hot combustion gases. Energy is extracted from the gases in a turbine which powers the compressor and produces useful work.

The turbine includes a row of rotor blades extending outwardly from a supporting disk, with each blade having an airfoil configured for extracting energy from the gases to rotate the disk. The airfoil has pressure and suction sides extending between leading and trailing edges and from root to tip. The airfoil tip is spaced radially inwardly from a stationary shroud to define a small gap therebetween. The gap is sized as small as practical to minimize the amount of combustion gas leakage therethrough for maximizing engine efficiency. However, differential expansion and contraction between the rotor blades and the stationary shroud occasionally permit tip rubs which must be accommodated.

Since the blade airfoil is bathed in hot combustion gases during operation, it is typically cooled by channeling therethrough a portion of air bled from the compressor. The airfoil is hollow and includes one or more cooling circuits therein which can have various configurations, and pins and turbulators for enhancing heat transfer of the cooling air therein. The airfoil typically includes rows of discharge holes through the sidewalls which produce cooling air films on the external surface of the airfoil for protection against the hot combustion gases.

However, the airfoil tip is particularly difficult to effectively cool since it is closely spaced near the shroud and is subject to combustion gas flow therebetween and occasional tip rubs.

Accordingly, a typical turbine blade tip includes a squealer tip rib which extends around the perimeter of the airfoil flush with its sides and defines a tip cavity and a floor therebetween. The tip rib reduces the surface area between the tip and shroud subject to tip rubbing, but is subject to heating from the three exposed sides thereof. Cooling air may be discharged through an axial row of film cooling holes below the pressure side tip rib for cooling thereof, and additional discharge holes may be provided through the tip floor for discharge into the tip cavity.

Since the airfoil tip varies in thickness between the leading and trailing edges, the effectiveness of the pressure side film cooling air is limited. As the film cooling air travels over the pressure side tip rib, it encounters combustion gas leaking through the tip gap. Recirculation of the cooling air and combustion gas within the tip cavity reduces the cooling effectiveness of the air in the tip gap.

Accordingly, it is desired to provide an improved turbine airfoil tip configuration having enhanced cooling for improving blade life.

BRIEF SUMMARY OF THE INVENTION

A turbine airfoil includes pressure and suction sidewalls extending between leading and trailing edges and from root to tip. The tip includes a floor bounding an internal cooling channel within the airfoil which channels cooling air. The airfoil tip includes a first rib adjacent the pressure sidewall, a second rib spaced therefrom to define a first slot, and a third rib adjacent the suction sidewall to define a second slot with the second rib. The tip floor includes feed holes extending between the cooling channel and the first slot for supplying cooling air therein for discharge over the second rib towards the third rib.

BRIEF DESCRIPTION OF THE DRAWINGS

The invention, in accordance with preferred and exemplary embodiments, together with further objects and advantages thereof, is more particularly described in the following detailed description taken in conjunction with the accompanying drawings in which.

DETAILED DESCRIPTION OF THE INVENTION

Figure 1:
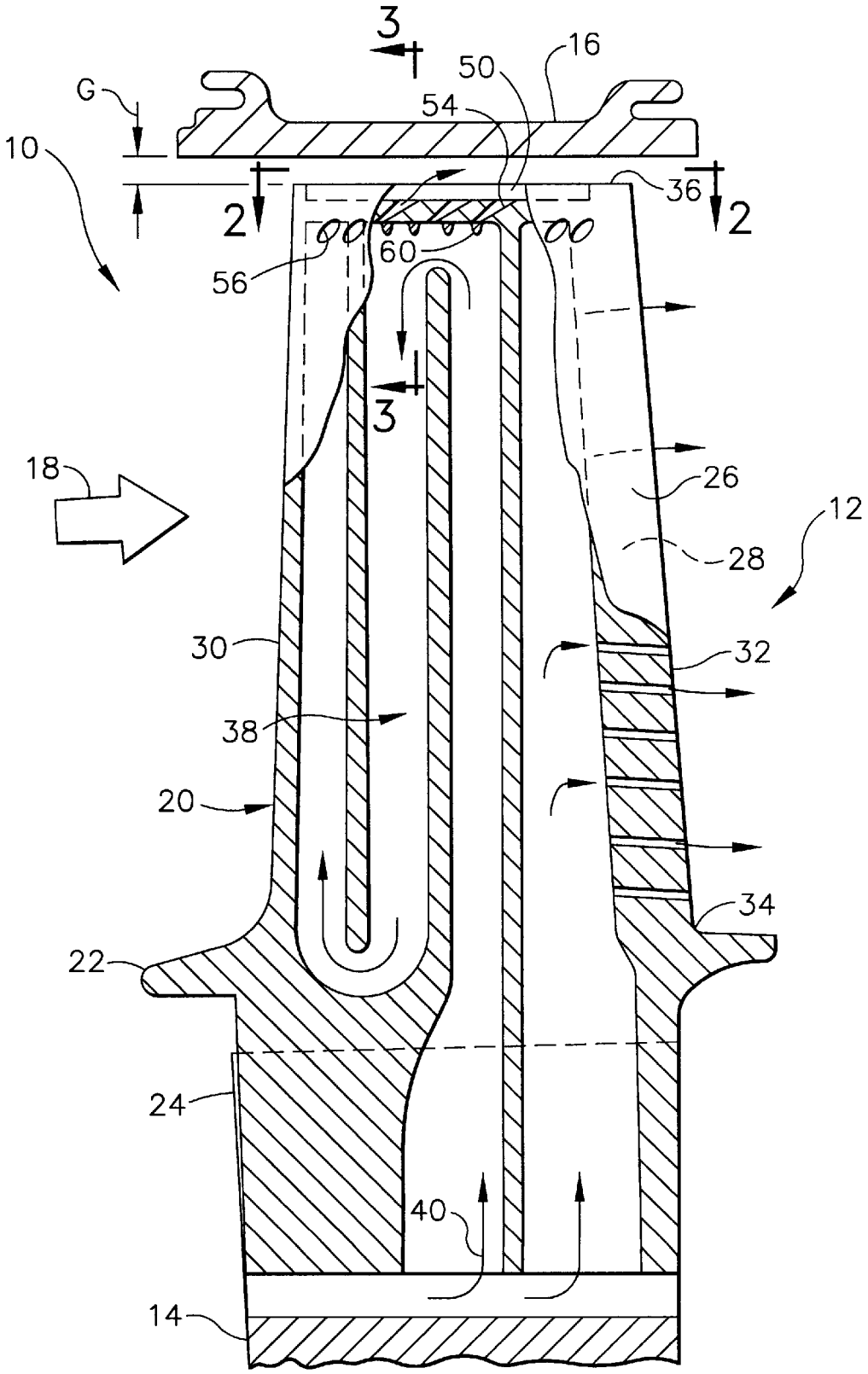
FIG. 1 is a partly sectional, elevation view of an exemplary gas turbine engine turbine rotor blade having an improved tip in accordance with an exemplary embodiment of the present invention spaced from a surrounding turbine shroud.

Illustrated in FIG. 1 is a portion of a turbine 10 of a gas turbine engine. The turbine includes a row of turbine rotor blades 12 extending radially outwardly from a rotor disk 14, shown in part. An annular turbine shroud 16 surrounds the blade row and is suitably supported from a stator casing (not shown).

During operation, air is pressurized in a compressor (not shown) and mixed with fuel and ignited in a combustor (not shown) for generating hot combustion gases 18 which flow downstream between the turbine blades which extract energy therefrom for rotating the disk 14 which in turn powers the compressor.

Each blade includes a hollow airfoil 20 extending radially outwardly from an integral platform 22 which defines the inner boundary for the combustion gases. The blade also includes an integral dovetail 24 extending below the platform for joining the blade to the disk in any conventional manner.

The blade airfoil includes a generally concave pressure sidewall 26 and a circumferentially opposite, generally convex, suction sidewall 28 extending axially between leading and trailing edges 30,32 and from a root 34 to tip 36.

The tip is spaced radially below the turbine shroud 16 to define a clearance or gap G therebetween which is sized sufficiently small for sealing flow of combustion gases therethrough.

The airfoil sidewalls are spaced laterally apart to define an internal cooling circuit or channel 38 for channeling therethrough cooling air 40 suitably bled from the compressor. The cooling channel 38 may have any conventional form such as the three-pass serpentine cooling channel illustrated for the airfoil forward half, and a separate single pass channel for the airfoil aft half portion. The cooling channel may include internal wall turbulators or pins for enhancing cooling air heat transfer, with the cooling air being discharged from the airfoil through various holes such as a row of trailing edge holes.

Figure 2:
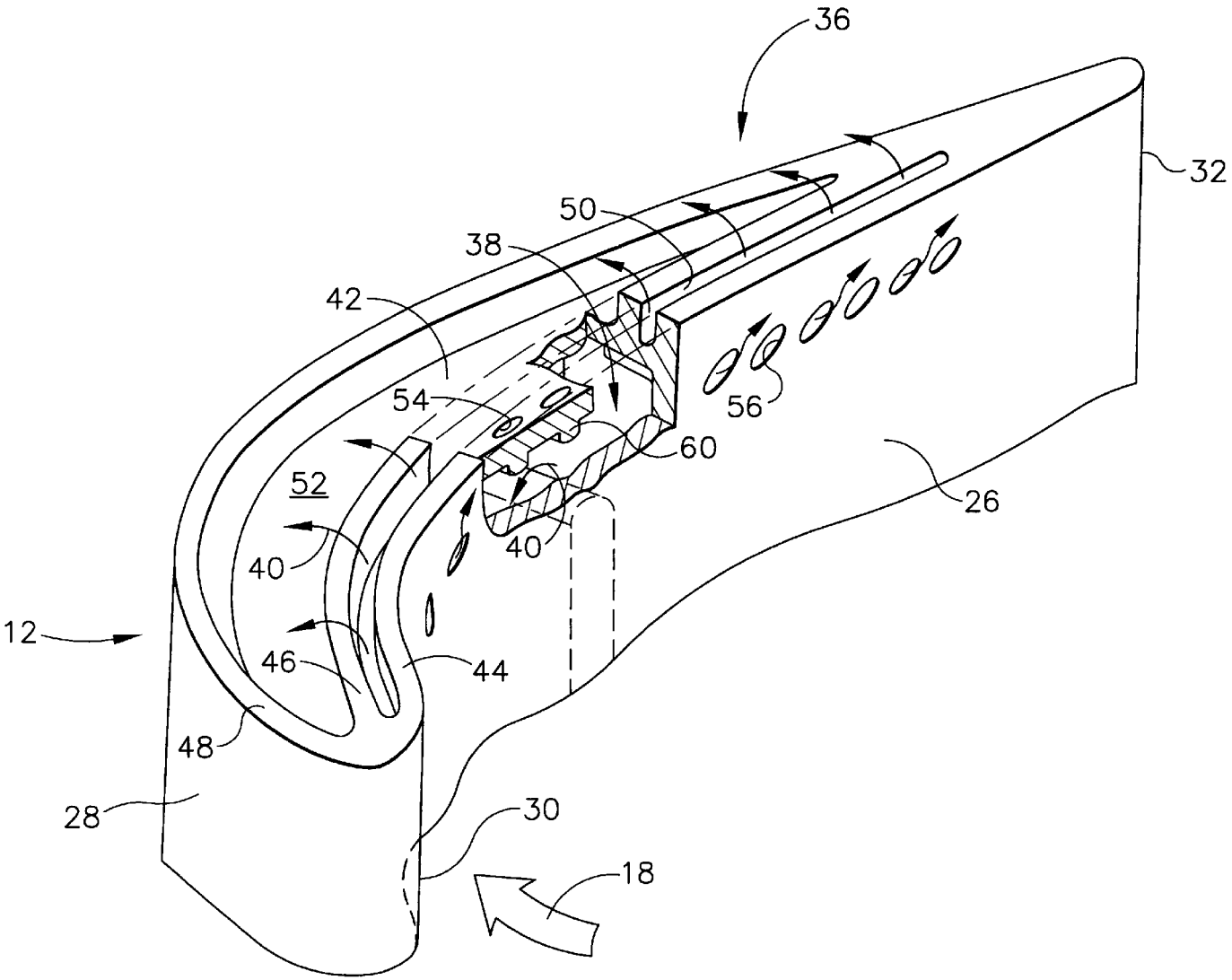
FIG. 2 is a partly sectional, isometric view of the airfoil tip shown in FIG. 1 and taken along line 2—2 illustrating three cooperating tip ribs in accordance with an exemplary embodiment of the present invention.

The airfoil tip 36 is illustrated in more detail in FIG. 2 in accordance with an exemplary embodiment of the present invention. The tip includes a floor 42 bounding the radially outer end of the cooling channel 38, with a plurality of squealer tip ribs extending outwardly from the floor and integral therewith typically in a common casting.

The tip ribs include a first rib 44 adjacent the airfoil pressure sidewall 26, a second rib 46 spaced therefrom, and a third rib 48 adjacent the airfoil suction sidewall 28. The second rib 46 is spaced circumferentially or laterally from the first rib to define a first trench or slot 50 therebetween. And, the third rib 48 is spaced laterally from the second rib to define a second slot or cavity 52 therebetween.

The tip floor 42 includes a plurality of feed holes 54 chordally spaced apart along a span axis running along the first slot 50, and extending in flow communication between the cooling channel 38 and the first slot 50 for supplying a portion of the cooling air 40 into the first slot for discharge therefrom over the second rib 46 towards the third rib 48 during operation. During operation, the predominate flow of the combustion gases 18 is between the leading and trailing edges of the airfoil, with secondary flow occurring across the blade tip between the pressure and suction sides.

The three tip ribs define with the turbine shroud a form of labyrinth seal for minimizing leakage of the combustion gases through the tip gap. By introducing the second rib 46 in conjunction with the first rib 44 to define the first slot 50 therebetween, that slot may be fed with cooling air for producing a substantially continuous film along the length of the slot for enhancing cooling effectiveness of the air during operation as it is discharged into the tip gap.

The cooling air provided inside the airfoil has a pressure significantly greater than that of the combustion gases for providing an effective backflow margin to prevent ingestion of the combustion gases inside the airfoil. Accordingly, individual air discharge holes typically emit local jets of air having limited film cooling capability between adjacent jets. The first slot 50 provides a continuous trench or gutter in which the air discharged from the feed holes 54 may laterally disperse for producing a more uniform film cooling air blanket along the axial extent of the first slot 50. In this way, the cooling air emitted from the first slot 50 not only cools the additionally provided second rib 46 but also provides enhanced cooling of the blade tip circumferentially across to the suction side third rib 48.

Figure 3:
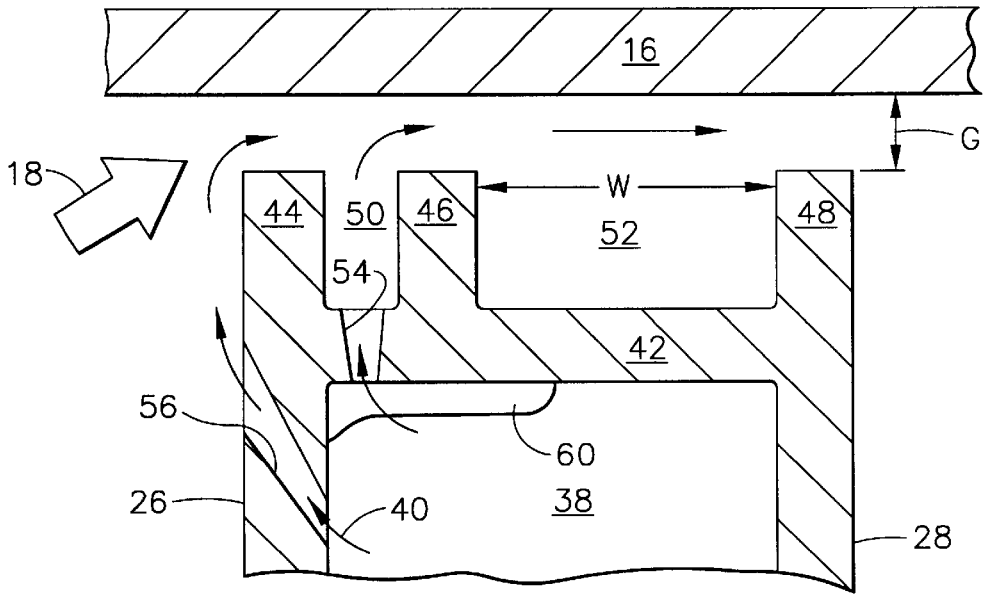
FIG. 3 is a radial sectional view through the airfoil tip illustrated in FIG. 1 and taken along line 3—3.
Figure 4:
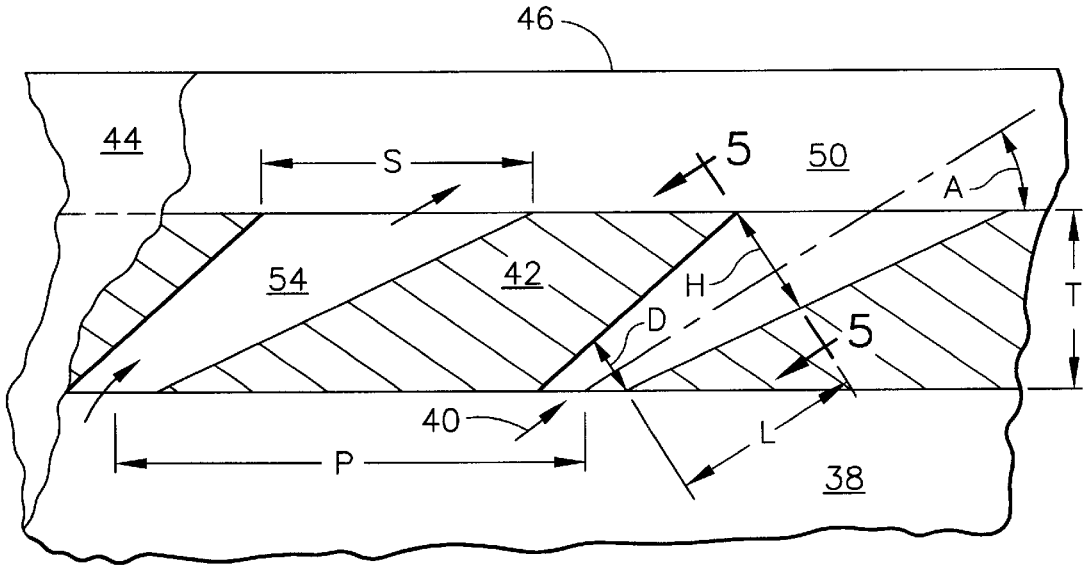
FIG. 4 is an enlarged view of a portion of the airfoil tip shown in FIG. 1 illustrating inclined diffusion feed holes in accordance with an exemplary embodiment of the invention.

As shown in more detail in FIGS. 3 and 4, the feed holes 54 diverge outwardly through the tip floor 42 for diffusing the cooling air into the first slot 50. Each feed hole 54 has an inlet at the underside of the floor 42 for receiving air from the channel 38, and a larger outlet atop the floor to feed the first slot. In this way, the cooling air has reduced velocity and increased pressure within the first slot 50 and is distributed therealong prior to discharge from the open outlet thereof atop the second rib 46. Air diffusion maintains a suitable backflow margin through the feed holes, with a correspondingly low blowing ratio to improve film cooling from the first slot.

The feed holes 54 are preferably inclined through the tip floor at an acute span angle A from the span axis for increasing their outlet area and coverage along the length of the first slot 50.

For example, the feed holes 54 may be conical in shape from inlet to outlet thereof for diffusing the cooling air. The holes may have circular cross sections, or elliptical cross sections increasing in diameter from inlet to outlet.

Alternatively, the feed holes may be fan diffusion holes having the same width from inlet to outlet between the first and second ribs 44,46 but increase in diameter in the radial direction for providing diffusion.

By inclining and diverging the feed holes 54 through the tip floor, the cooling air more effectively fills the first slot 50 prior to discharge therefrom. The increased coverage provided by such feed holes permits a reduction in the overall number of feed holes for sufficiently supplying cooling air into the first slot 50.

Performance of the feed holes 54 may be evaluated using a coverage parameter. Coverage is represented by the span height or lengths of the feed hole at its outlet along the tip floor divided by the pitch spacing of the adjacent holes. For an inclined cylindrical hole, the outlet span height is simply the diameter of the hole divided by the sine of the inclination angle.

As shown in FIG. 4, the spanwise inclination of the feed holes 54 may be defined by the acute span angle A between the axial centerline of the feed hole and the span axis extending chordally along the surface of the tip floor 42. In a preferred embodiment, the span angle is about 45° to discharge the cooling air aft in the first slot 50 towards the trailing edge.

Figure 5:
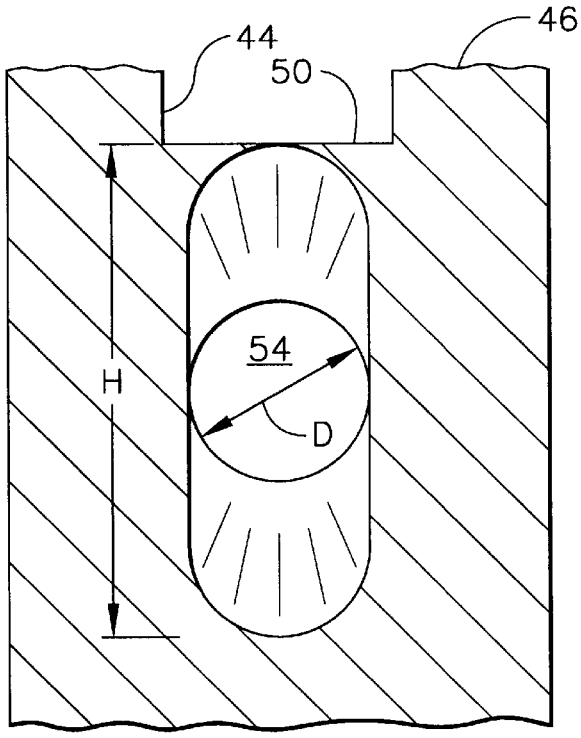
FIG. 5 is an end-sectional view through one of the feed holes illustrated in FIG. 4 and taken along line 5—5.

The preferred fan-shaped feed holes 54, shown in end-section in FIG. 5, have a circular inlet with a diameter D of about 10 mils (0.254 mm), and a larger, oval or race-track outlet having a span height H of about 2.57D for obtaining an effective area ratio of about 3:1, for example. This area ratio is also obtained from a sufficient hole divergent length L and tip floor thickness T and inclination angle A as shown in FIG. 4. The width of the feed hole is preferably constant from inlet to outlet. The feed holes have a pitch spacing P from center-to-center at their inlets, which may be about five inlet diameters D.

Since the feed holes are inclined through the tip floor 42, the feed hole outlets have an even larger spanwise lengths to increase their effective coverage for a given pitch spacing. The coverage equation results in a chordwise coverage value of about 73%, which is the projected span heights 2.57D/Sin 45° divided by the pitch spacing 5D, for example.

This is a significant coverage increase over simple inclined conical holes having a corresponding coverage of 49%, or inclined cylindrical holes having a corresponding coverage of 28%, all with the same pitch spacing and inlet hole diameter. The constant-width fan feed holes diverge solely along the span axis and provide maximum exit air coverage, as compared to the conical feed holes diverging in two-dimensions along their centerline axes.

Accordingly, the inclined fan or conical feed holes can provide enhanced exit coverage inside the first slot 50, without compromising airfoil strength. They improve the chordal extent of the film cooling air discharged therefrom, both with suitable backflow margin, and low blowing ratio. These features combine to enhance airfoil tip cooling.

As illustrated in FIGS. 2 and 3, the first and second ribs 44,46 are preferably parallel to each other along the full extent of the first slot 50 for discharging the cooling air therefrom closely adjacent to the pressure sidewall 26. In this embodiment, the first slot 50 has a substantially uniform width along its length, with all three ribs 44,46,48 preferably having the same height from the tip floor to define substantially equal tip gaps G with the surrounding turbine shroud 16.

In this way, each of the tip ribs provides an effective barrier for limiting combustion gas leakage therepast in a more effective tip seal. And, the three ribs are subject to simultaneous tip rubs with the shroud 16 for ensuring uniform wear thereof to maintain comparable tip sealing effectiveness and tip cooling during operation.

In the preferred embodiment illustrated in FIGS. 2 and 3, the first slot 50 is smaller in width than the second slot 52 over most of its length, with the heights of the three ribs being preferably equal. The twin ribs 44,46 defining the narrow first slot 50 ensure the formation of an effective blanket of film cooling air discharged therefrom during operation along the full length of the narrow slot. Since the first slot 50 is narrow and fed with air from the several feed holes 54, backflow of the combustion gases into the first slot is prevented which more effectively cools the twin ribs 44,46, and with enhanced film cooling across the wider second slot or cavity 52.

The introduction of the second rib 46 necessarily decreases the width of the remaining second slot 52, which correspondingly reduces the ability for the combustion gases to recirculate therein for causing heating hereof. The improved blanket of cooling air discharged form the first slot 50 provides a more effective barrier against the combustion gases for further protecting the second slot 52 and the third rib 48 along its boundary.

As shown in FIG. 2, the first rib 44 is preferably coextensive or flush with the pressure sidewall 26 from leading to trailing edge. The third rib 48 is preferably coextensive or flush with the suction sidewall 28 from leading to trailing edge and integrally joins the first rib 44 thereat. The second rib 46 may be suitably introduced between the leading and trailing edges where desired, and in the exemplary embodiment illustrated in FIG. 2 extends from the leading edge to the trailing edge where it blends with the first and third ribs. In this way, the first slot 50 extends from the leading edge 30 to the trailing edge 32 within the available space provided by the narrow trailing edge.

As shown in FIGS. 2 and 3, the airfoil tip may also include a row of film cooling holes 56 extending through the pressure sidewall 26 at the elevation of the tip floor for discharging a portion of the cooling air in a film along the pressure side and over the first rib 44. In this way, the first rib 44 is initially film cooled, with the air channeled thereover meeting the cooling air discharged from the first slot 50. The film cooling holes 56 preferably diverge in configuration for diffusing the cooling air as it is discharged from the airfoil. The film cooling holes may be conical, elliptical, or fan diffusion holes as desired for increasing air coverage while providing effective diffusion.

Figure 6:
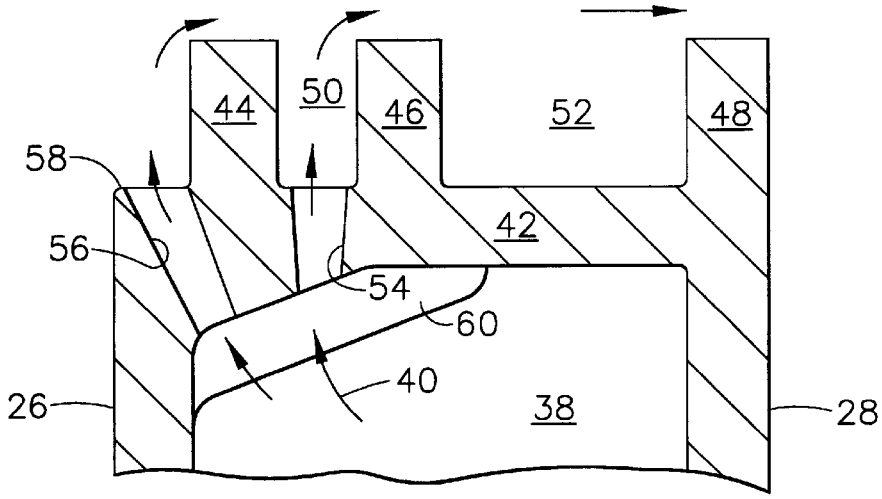
FIG. 6 is a radial sectional view, like FIG. 3, illustrating the airfoil tip in accordance with another embodiment of the present invention.

FIG. 6 illustrates an alternate embodiment of the present invention wherein the first rib 44 is laterally offset from the pressure sidewall 26 to define a shelf 58 which extends between the leading and trailing edges and blends thereat. The tip shelf 58 is preferably coextensive with the tip floor 42 and provides a local interruption in the pressure side of the airfoil along the first rib 44.

In this embodiment, the pressure side film cooling holes 56 extend through the tip floor 42 between the cooling channel 38 and the shelf 58 for supplying cooling air thereat for film cooling the first rib 44 from its pressure side.

The film cooling holes 56 preferably diverge through the tip floor 42 for diffusing the air on to the shelf 58. And, the film cooling holes 56 are preferably inclined through the tip floor for increasing coverage of the cooling air chordally along the tip shelf 58. As indicated above, the film cooling holes 56 may be conical, elliptical, or fan shaped for increasing air coverage along the tip shelf 58. And, the air along the tip shelf forms a more uniform film as its flows over the pressure side of the first tip rib 44 for providing enhanced cooling thereof before and after it meets the cooling air discharged from the first slot 50.

As shown in FIGS. 1 and 2, the film cooling holes 56 in either embodiment of FIGS. 3 and 6 are preferably staggered along the chord axis with the feed holes 54 for maintaining structural integrity of the airfoil tip and complementing the film cooling blankets discharged from the respective holes.

As shown in FIGS. 2, 3, and 6 the airfoil tip preferably also includes a plurality of rib turbulators 60 extending radially inwardly from the underside of the tip floor 42 inside the cooling channel 38. The turbulators 60 are preferably disposed under the second rib 46 for providing enhanced cooling of the airfoil tip below the twin ribs 44,46.

The turbulators 60 preferably extend from below the second rib 46 to the pressure sidewall 26. One end of the turbulators is therefore preferably joined integrally with the pressure sidewall 26, and the opposite ends of the turbulators preferably terminate at or near the second rib 46 short of the suction sidewall 28. In this way, the turbulators 60 provide enhanced cooling below the twin ribs 44,46 without introducing excessive pressure drop in the cooling air flowing within the cooling channel 38.

The improved airfoil tip disclosed above introduces one or more enhancements in configuration for more effectively cooling the airfoil tip while maintaining an effective labyrinth seal with the surrounding turbine shroud 16. The twin-ribs along the airfoil pressure sidewall introduce a chordally continuous blanket of film cooling air into the tip gap upon discharge from the pressure side narrow slot 50. With sufficient width W of the second slot 52, the cooling air film flows downstream into the second slot for recirculation cooling and protecting this portion of the airfoil tip and the third rib 48 from the hot combustion gases.

The pressure side film cooling holes 56 provide additional cooling of the first rib 44 and join with the cooling air discharged from the first slot 50 for enhanced cooling of the airfoil tip. The introduction of the tip floor turbulator 60 provides additional internal cooling of the additionally provided second rib 46 if desired. The corresponding enhanced cooling of the airfoil tip more effectively utilizes the limited available cooling air, and promotes enhanced blade life.

While there have been described herein what are considered to be preferred and exemplary embodiments of the present invention, other modifications of the invention shall be apparent to those skilled in the art from the teachings herein, and it is, therefore, desired to be secured in the appended claims all such modifications as fall within the true spirit and scope of the invention.

Accordingly, what is desired to be secured by Letters Patent of the United States is the invention as defined and differentiated in the following claims in which I claim:

1. A gas turbine airfoil comprising:

pressure and suction sidewalls extending between leading and trailing edges and from root to tip, and spaced apart to define an internal cooling channel for channeling cooling air;

said tip including a floor bounding said cooling channel, and a plurality of ribs extending outwardly from said floor;

said tip ribs including a first rib adjacent said pressure sidewall, a second rib spaced from said first rib to define a first slot therebetween, and a third rib adjacent said suction sidewall and spaced from said second rib to define a second slot therebetween, and said first, second, and third ribs integrally joined together at said leading and trailing edges;

said tip floor including a plurality of diverging feed holes spaced apart along a slot span axis running along said first slot, and each of said feed holes extends between an inlet at said cooling channel and an outlet at said first slot for supplying cooling air therein for discharge therefrom over said second rib toward said third rib; and said feed holes being inclined at an acute span angle from said span axis for increasing coverage of said outlets inside said first slot.

2. An airfoil according to claim 1 wherein said feed holes diverge through said tip floor with increasing height along said span axis for diffusing said air into said first slot.

3. An airfoil according to claim 2 wherein said feed holes are circular in section at said inlets, and increase in flow area therefrom.

4. An airfoil according to claim 3 wherein said first and second ribs are parallel to each other along said first slot.

5. An airfoil according to claim 4 wherein said first slot is smaller in width than said second slot.

6. An airfoil according to claim 4 wherein said first and second ribs are equal in height.

7. An airfoil according to claim 4 wherein said first rib is coextensive with said pressure sidewall, and said third rib is coextensive with said suction sidewall.

8. An airfoil according to claim 4 wherein said first slot extends from said leading edge to said trailing edge between corresponding juncture of said first, second, and third ribs thereat.

9. A gas turbine airfoil comprising:

pressure and suction sidewalls extending between leading and trailing edges and from root to tin, and apart to define an internal cooling channel for channeling cooling air;

said tip including a floor said cooling channel, and a plurality of ribs extending outwardly from said floor;

said tip ribs including a first rib offset from said pressure sidewall to define a shelf thereat, a second rib spaced parallel from said first rib to define a first slot therebetween, and a third rib adjacent said suction sidewall and spaced from said second rib to define a second slot therebetween, and said first, second, and third ribs are integrally joined together at said leading and trailing edges;

said tip floor including a plurality of diverging feed holes spaced apart along a slot span axis running along said first slot, and each of said feed holes extends between an inlet at said cooling channel and an outlet at said first slot for supplying cooling air therein for discharge therefrom over said second rib toward said third rib; and said feed holes being inclined at an acute span angle from said span axis for increasing coverage of said outlets inside said first slot.

10. An airfoil according to claim 9 wherein said tip floor further includes a plurality of film cooling holes extending between said cooling channel and said shelf for supplying cooling air thereat for film cooling said first rib.

11. An airfoil according to claim 10 wherein said film cooling holes diverge through said tip floor for diffusing said air onto said shelf.

12. An airfoil according to claim 11 wherein said film cooling holes are inclined through said tip floor for increasing coverage of said air along said shelf.

13. An airfoil according to claim 12 wherein said film cooling holes are staggered with said feed holes.

14. A gas turbine airfoil comprising;

pressure and suction sidewalls extending between leading and trailing edges and from root to tip, and spaced apart to define an internal cooling channel for channeling cooling air;

said tip including a floor bounding said cooling channel, a plurality of ribs extending outwardly from said floor, and a plurality of turbulators extending from an underside of said tip floor inside said cooling channel;

said tip ribs including a first rib adjacent said pressure sidewall, a second rib spaced parallel from said first rib to define a first slot therebetween, and a third rib adjacent said auction sidewall and spaced from said second rib to define a second slot therebetween, and said first, second, and third ribs are integrally joined together at said leading and trailing edges;

said tip floor including a plurality of diverging feed holes spaced apart along a slot span axis running along said first slot, and each of said feed holes extends between an inlet at said cooling channel and an outlet at said first slot for supplying cooling air therein for discharge therefrom over said second rib toward said third rib; and said feed holes being inclined at an acute span angle from said span axis for increasing coverage of said outlets inside said first slot.

15. An airfoil according to claim 14 wherein said turbulators are disposed under said second rib.

16. An airfoil according to claim 15 wherein said turbulators extend from said second rib to said pressure sidewall.

17. An airfoil according to claim 16 wherein said turbulators terminate at said second rib.

18. An airfoil according to claim 4 wherein said feed holes have a constant width, and diverge solely along said span axis.

19. An airfoil according to claim 18 wherein said feed holes are oval at said outlets.

* * * * *